United States Patent [19]

Bushnell

[11] B 4,013,549

[45] Mar. 22, 1977

[54] LUBE EXTRACTION WITH NMP/PHENOL/WATER MIXTURES

[75] Inventor: James D. Bushnell, Berkeley Heights, N.J.

[73] Assignee: Exxon Research and Engineering Company, Linden, N.J.

[22] Filed: June 5, 1974

[21] Appl. No.: 476,542

[44] Published under the second Trial Voluntary Protest Program on March 30, 1976 as document No. B 476,542.

Related U.S. Application Data

[63] Continuation-in-part of Ser. No. 311,287, Dec. 1, 1972, abandoned.

[52] U.S. Cl. ..... 208/323; 208/324

[51] Int. Cl.[2] ..... C10G 21/06

[58] Field of Search ..... 208/323, 326, 18, 324

[56] References Cited

UNITED STATES PATENTS

| | | | |
|---|---|---|---|
| 2,754,249 | 7/1956 | Myers et al. | 208/323 |
| 2,771,494 | 11/1956 | Weedman | 208/323 |
| 2,902,444 | 9/1959 | Shmidl | 208/323 |
| 3,415,742 | 12/1968 | Eisenlohr et al. | 208/323 |
| 3,472,757 | 10/1969 | Morris et al. | 208/326 |
| 3,476,681 | 11/1969 | Davies et al. | 208/326 |

*Primary Examiner*—Herbert Levine
*Attorney, Agent, or Firm*—Edward M. Corcoran

[57] ABSTRACT

Lubricating oil stocks are upgraded by contacting same with a solvent comprising a mixture of n-methyl-2-pyrrolidone (NMP) and phenol. The solvent may also contain a minor amount of water. The phenol concentration in the solvent ranges between about 20 and 80 LV% based on the total amount of NMP, phenol and water in the solvent, while the water concentration in the solvent ranges between 0 and about 10 LV% based on the total amount of NMP, phenol and water in the solvent and preferably between about 1 and 4 LV%. At least a portion of the solvent is recovered from the thus-formed extract and raffinate phases by heating same to temperatures in the range of about 500° to 700° F., thereby flashing off the bulk of the solvent; remaining solvent may be stripped out from the extract and raffinate phases with an inert gas such as nitrogen, light hydrocarbons or hydrogen at superatmospheric pressures. The hot, stripped raffinate may be sent directly to a hydrofiner reactor, if desired, for further improvement of color, carbon residue, viscosity characteristics, sulfur removal, etc.

20 Claims, 2 Drawing Figures

Figure I

MISCIBILITY TEMPERATURES VS. COMPOSITION
FOR PHENOL/NMP/$H_2O$/ARAB LIGHT 150N DISTILLATE SYSTEM
DATA FROM TABLE I

LUBE EXTRACTION WITH NMP/PHENOL/WATER MIXTURES

CROSS REFERENCE TO RELATED APPLICATION

This application is a continuation-in-part of copending application Ser. No. 311,287 filed Dec. 1, 1972 now abandoned.

BACKGROUND OF THE INVENTION

1. Field of the Invention

The present invention relates to a process for upgrading lubricating oil stocks. More specifically, the process relates to solvent treating a lubricating oil stock with a solvent comprising a mixture of n-methyl-2-pyrrolidone (NMP) and phenol, which may also contain a minor amount of water, thereby removing at least a part of the aromatic, sulfur and nitrogen-containing constituents contained in the lubricating oil stock. Still more specifically, the process relates to improvements in the recovery of solvent from raffinate and extract phases formed during the extraction operation.

2. Description of the Prior Art

In prior art extraction processes utilizing phenol and/or phenol-water solvent systems, several process difficulties have been encountered. Typical of such prior art extraction processes is that disclosed in U.S. Pat. No. 3,329,606, which discloses a process comprising introducing a feedstock into an extraction column and contacting the feed therein with phenol. The phenol is introduced into the top of the tower and contacted therein countercurrently with the upward rising feedstock. Simultaneously, phenolic water is introduced near the bottom of the column. The overall object of the process is to improve the efficiency of the phenol/-water solvent extraction system. This is accomplished by providing internal reflux near the bottom of the column by increasing the selectivity of the solvent at that point.

Another process which utilizes phenol or phenolic water is that described in U.S. Pat. No. 2,923,680. Specifically, the process described therein is directed to improvements in the recovery of phenol from raffinate and extract products obtained when subjecting a lubricating oil stock to a phenol extraction treatment. The process comprises heating the raffinate and extract phases in separate heating zones to temperatures ranging between about 450° and 750°F., thereby vaporizing a major portion of the phenol present in the respective phases. Residual quantities of the solvent are thereafter removed by contacting the raffinate and extract phases with a non-aqueous stripping gas. This separation process represents an improvement over those described in the prior art which generally utilizes steam as the stripping agent. Steam stripping has the disadvantage of getting water into the extraction unit, which water must then be removed to keep the proper solvent composition. The difficulty apparently involved in removing the residual water results in an unattractive economic configuration.

As indicated supra, the phenol/water solvent systems have led to difficulties in solvent recovery and solvent aromatic constituent selectivity. Examples of such difficulties include the relatively slow settling rate of the raffinate and extract phases in a multi-tray extraction zone when the extraction solvent is aqueous phenol due to the low interfacial surface tension of the two phases, and the relatively high viscosities at the operating temperature of the extraction zone. This often leads to inter-tray entrainment, and also to entrainment of oil feed in the extract phase leaving the tower bottom. In this manner, raffinate yield is lowered. Additionally, post-extraction hydrofining operations, necessary to improve raffinate product color, must be run at relatively high severity in order to achieve color specifications. Furthermore, relatively large amounts of water are normally required to be added to the phenol in order to obtain the desired solvent selectivity (typically 5–10 percent). The high water content is detrimental in view of the large heat input needed for solvent recovery (water has about 5 times the latent heat of vaporization per pound of phenol). Additionally, the separated phenolic water solvent system condenses as a two liquid phase system, i.e., wet phenol and phenolic water. This makes it more difficult to control the critical water content in the extraction solvent, since the two phases do not readily separate and are usually pumped away as an emulsion of variable water content.

Other solvents have been used in extraction processes in an attempt to avoid the above-mentioned problems. Typical of such prior art processes include that described in U.S. Pat. No. 3,476,681 wherein the solvent comprising n-methyl-2-pyrrolidone and water is used to extract aromatic constituents from a lubricating oil stock. The process utilizes a rather complex separation configuration to remove solvent from extract and raffinate phases and it is therefore economically unattractive. Furthermore, NMP is not as efficient as phenol in removing undesirable organic nitrogen compounds from the raffinate.

Other prior art processes, such as that described in U.S. Pat. No. 3,496,069 have utilized solvent mixtures such as n-methyl-2-pyrrolidone, water and phenol in extraction processes. The 3,496,069 process, however, is directed to the preparation of high purity alkadienes of 4 to 5 carbon atoms containing low quantities of alkanes and is not concerned with lube oil stock preparation. In addition, U.S. Pat. No. 3,556,987 and U.S. Pat. No. 3,617,495 disclose the use of n-methyl-2-pyrrolidone/phenol solvents for use in naphtha (b.p. 100°–400°F) extraction, again bearing no relationship to lube oil stock preparation In view of the above-mentioned problems in the preparation of high quality lubricating oil stocks, it would be desirable to develop an extraction process for the preparation of high V. I. lubricating oils of good color, utilizing a solvent system that avoids the above-mentioned difficulties existing in present prior art processes, and further, permits rapid settling of extract and raffinate phases in the extraction tower, eliminates or substantially reduces the severity of the post-extraction hydrofining operation, and the amount of water required in the solvent mixture.

SUMMARY OF THE INVENTION

In accordance with the subject invention, high quality lubricating oils characterized by having a high viscosity index and good color are prepared from aromatic, sulfur and nitrogen-containing hydrocarbon feedstocks, by contacting same with a solvent comprising a mixture of n-methyl-2-pyrrolidone (NMP) and phenol. The solvent may also contain a minor amount of water. The process, besides providing a highly selective solvent for removing, e.g., aromatic-type constituents from hydrocarbon feedstocks, also provides facile phase separation of extract and raffinate phases, and further, provides a means for efficiently separating solvent from the extract and raffinate phases.

A key feature of this invention lies in the fact that an unexpected, synergistic effect occurs when NMP/phenol mixtures are used as the solvent for lube oil extraction. It has been found that mixtures of NMP and phenol yield solvent/oil miscibility temperatures substantially higher than either NMP or phenol alone. This effect occurs whether or not water is present in the solvent, as will be discussed later. Higher solvent/oil miscibility temperatures permit extraction to take place at higher temperatures, which results in a reduction of the viscosity of the extract and raffinate phases, thereby permitting more rapid settling of same and also reducing the amount of heat subsequently needed to remove the solvent from both phases.

By higher miscibility temperature is meant that temperature at which the solvent and oil just become miscible and form a single phase. this temperature is also known as the critical solution temperature. Below the miscibility temperature, the solvent and oil exist as two separate phases. Therefore, a solvent having a higher miscibility temperature will yield two phases at higher temperatures than will a solvent having a lower miscibility temperature. The two phases will comprise a solvent-rich phase and an oil-rich phase.

In one embodiment of the invention, at least a portion of the solvent contained in the raffinate phase is removed, in a separation zone, at a temperature ranging between about 400° and 750°F. and at a pressure ranging between about 6 and 60 psig, most preferably about 45 psig. The separation process preferably comprises a fractionation or distillation operation. Residuary portions of solvent not removed by the above separation operation may be removed therefrom by contacting same with a substantially non-reactive stripping gas. The same process sequence is performed with the extract phase resulting in a substantial reduction in the solvent content of same. Recovered solvent can then be recycled for use in the initial extraction operation.

An important additional feature of the subject process relates to the use of a minor portion of the raffinate and extract phases as reflux in the respective separation zones, in order to cool overhead vapors of solvent and oil in the separation zones and to prevent carryover of excessive oil vapor with the solvent.

The process disclosed herein is designed to remove the more polar components from a feed comprising a mixture of hydrocarbons. Specifically, the process is designed to separate the more aromatic-type constituents as well as organic sulfur and nitrogen-containing compounds from a feed containing a mixture of these constituents with non-aromatic, or paraffinic and/or naphthenic hydrocarbons. In general, any feed boiling above about 550°F (atmospheric pressure) and substantially free of asphaltic materials is suitable for use in the subject process. More particularly, such feeds will consist of petroleum distillate fractions or lube residua (deasphalted oils). In general, the distillate fractions will have a boiling point range within the broad range of about 550°F to about 1100°F. Preferred distillate fractions include the lubricating oil fractions boiling within the range of 600°F and 1050°F (atmospheric pressure), containing between about 5 and about 70 percent (by weight) of polar aromatic compounds such as substituted benzenes, naphthalenes, anthracenes, and phenanthrenes, characterized by having a carbon content of $C_{15}$–$C_{50}$. Nonlimiting examples of useful process feedstocks include crude oil vacuum distillates from paraffinic and/or naphthenic crudes, deasphalted residual oils, the fractions of catalytic cracking cycle oils, coker distillates and/or thermally cracked oils boiling above about 600°F and the like. These fractions may be derived from petroleum crude oils, shale oils, tar sand oils, and the like.

The preferred feedstocks include the light distillates having boiling points ranging from about 550°–700°F, with typical viscosities of about 60–80 SSU/100°F, which distillates are used for the preparation of transformer oil, spindle oil, light white oil base stocks, etc., up through the heavy solvent neutrals which boil between about 1000° and 1100°F, for example, and have a finished viscosity of 1000 to 1500 SSU/100°F. More viscous bright stocks (ca. 2500–3000 SSU/100°F) are produced from deasphalted oils made by propane deasphalting a vacuum pipestill bottoms having a 950°–1050°F initial cut point. The instant distillate fractions and lube residua may come from any crude source, such as the paraffinic crudes obtained from Aramco Kuwait, Panhandle, North Louisiana, Western Canada and the like and various naphthenic crudes such as U.S. Coastal, Venezuelan and Canadian Cold Lake crudes.

The composition of the solvent in the subject process will comprise, as indicated above, a mixture of n-methyl-2-pyrrolidone and phenol and it may also contain a minor amount of water. As previously indicated, it has been found that a solvent comprising mixtures of n-methyl-2-pyrrolidone (NMP) and phenol yield unexpectedly higher solvent/oil miscibility temperatures than either NMP or phenol, whether anhydrous or containing a minor amount of water. This is readily seen from the data in Table I and in FIG. 1, wherein said data is plotted. The effect of adding water to NMP, phenol and/or mixtures thereof is also shown in FIG. 1. The addition of water to the solvent results in increasing the solvent/oil miscibility temperature for all solvent combinations. However, it is apparent from the data and FIG. 1 that a point of diminishing returns will eventually be reached, beyond which the continued addition of water will yield less and less of an increase in miscibility temperature.

By way of illustration, the miscibility temperature of a solvent consisting of an anhydrous, 50/50 LV% (equal volume) mixture of NMP and phenol will be about 232°F., while that for anhydrous phenol is about 167°F. and for anhydrous NMP is about 183°F. Adding 3 LV% water to the solvent increases the miscibility temperature of the 50/50 mixture of 285°F., which is still 23°F. higher than the miscibility temperature of NMP containing 3 LV% water and 81°F higher than the miscibility temperature of phenol containing 3 LV% water.

In one embodiment of the invention, the solvent comprises an anhydrous mixture of NMP and phenol and the phenol ranges from about 20 to about 80 LV% based on the total solvent (NMP + phenol). In another embodiment of the invention, the solvent comprises a mixture of NMP and phenol along with a minor amount of water, i.e., 0 to 10 LV% based on the total amount of phenol, NMP and water in the solvent. In a preferred embodiment of the invention, the water will comprise between about 1 and about 4 LV% and the phenol concentration in the solvent will comprise between about 20 and 80 LV% based on total amount of phenol, NMP and water in the solvent, preferably between 25 and 50 LV%. The usefulness of the solvent in oil extractions, both with and without water, is shown in Examples 1–4 infra.

The extraction process is performed at temperatures such that the feed and solvent remain substantially in the liquid phase. In addition, the conditions are such that the feed and solvent are partially miscible. It is noted that the extraction temperature is limited by the critical solution or miscibility temperatures of the feed and solvent. These are primarily affected by the feed and solvent composition. More particularly, it has been found that certain temperatures within the range thus provided are economically more attractive than others. Specifically, preferred extraction temperatures range from about 100°F to about 300°F, most preferably from about 120°F to about 250°F. Typically, the extraction zone temperatures are about 40°–75°F lower than the miscibility temperatures for the feedstock and solvent composition under consideration. The amount of solvent to be employed in conjunction with the subject invention may vary over a wide range. This amount is limited in any given extraction temperature and solvent composition by the solubility of the oil in the solvent system, by the feedstock characteristics and desired product quality, and in addition, by economic considerations. More particularly, preferred treat/solvent oil ratios will range between about 50 and 500 LV%, preferably between about 100 and 300 LV%.

In conjunction with the process of the present invention, it is noted that, except at very high pressures, the influence of pressure on the extraction equilibrium is negligible. The invention assumes the use of sufficiently high operating pressures in the extraction zone to maintain a substantially completely liquid system, i.e, above the vapor pressure of the solutions at the highest temperature used.

In general, the various means customarily utilized in extraction processes to increase the contact area between the oil stock and the solvent can be employed. Thus, the apparatus used in the instant process can comprise a single extraction zone or multiple extraction zones equipped with shed rows or other stationary devices to encourage contacting, orifice mixers, or efficient stirring devices, such as mechanical agitators, jets of restricted internal diameter, turbo mixers and the like. The operation may be conducted as a batchwise or as a continuous-type operation with the latter operation being preferred. A particularly preferred operational configuration comprises continuous countercurrent extraction. It is important to note that the equipment employed in the operation of the extraction process is not critical to the overall efficiency of the extraction and can comprise rotating disc contactors, centrifugal contactors, countercurrent packed bed extraction columns, countercurrent tray contactors and the like.

In a particularly preferred embodiment of the invention, the extraction zone will comprise a vertical tower with the feedstock being charged to the lower part of the tower and NMP in combination with phenol or in combination with phenol and water, being charged to the top of the column. Continuous countercurrent liquid/liquid extraction would prevail within the column to extract the desired amount of aromatic constituents from the hydrocarbon feedstock.

The solvent may be premixed and introduced as such into the extraction zone or, alternatively and preferably, the components of the solvent introduced separately therein. Thus, in the latter embodiment, a water-containing stream, is injected continuously into the bottom of the countercurrent extractor (normally below the point of feed entrance) with a relatively dry NMP/phenol mixture being introduced near the top of the extractor. This introduction of solvent containing water at the bottom of the extraction zone reduces the solubility of oil in the extract phase. By this means, the selectivity of the extraction is enhanced and a higher raffinate yield of a given quality may be achieved.

The raffinate and extract phases which form during the extraction are subsequently removed from the extraction zone and thereafter separated and the solvent recovered therefrom utilizing the unique separation process of the subject invention. The recovered solvent from the two phases may then be combined and thereafter recycled to the initial extraction zone. The raffinate phase will contain the bulk of the desired lube oil components of the hydrocarbon feedstock in addition to small amounts of dissolved solvent; on the other hand, the extract phase will contain a major amount of solvent and most of the aromatic-type constituents of the hydrocarbon feedstock, particularly multi-ring aromatics and polar compounds, in addition to minor amounts of lube oil components. As indicated above, an important object of the subject process is to provide an efficient mode of solvent separation from the raffinate and extract phases and the subsequent recycling of the separated solvent to the initial extraction operation. This is an important consideration from an economic viewpoint.

In furtherance of the above objectives, the raffinate and extract phases are preferably processed as follows: first, in regard to the raffinate phase, the latter is heated to a temperature ranging between about 500° and 700°F. in a separation zone and at a pressure ranging between about 0 and 60 psig, preferably between about 30 and 50 psig, thereby removing a substantial portion of the solvent contained therein. The stripping gas which can comprise a substantially nonreactive gas such as hydrogen, methane, propane, nitrogen or the like is introduced into the separation zone, preferably at the bottom of the zone, for removing final traces of solvent from the lubricating oil stock. As indicated previously, an important aspect of the subject process is the use of at least a portion of the raffinate phase as a reflux aid in the separation zone. The raffinate phase, prior to introduction into the separation zone, can be divided into two streams, one of which represents a major portion of the raffinate phase and the other representing a minor portion of the raffinate phase. The latter stream is introduced into the top of the tower, in a preferred embodiment of the invention, at a temperature below that of the former stream. In general, the reflux stream, which terminology is applied to the stream representing a minor portion of the raffinate phase, will be introduced into the separation zone at a temperature ranging between about 100° and 400°F., preferably between about 150° and 250°F. and further, at a temperature between about 400° and 550°F. below that of the stream containing the bulk of the raffinate phase.

The hereinabove mentioned separation process may also be directed to the extract phase for removal of solvent therefrom.

The separation zone may consist of any equipment designed to accomplish the objectives of the solvent removal aspect of the subject invention. Stripped solvent is then condensed in a suitable condensing system and is thereafter recycled to the extraction process for use therein.

Four curves are plotted. Each curve shows solvent/oil miscibility temperatures for solvent comprised of various ratios of phenol/NMP, and at a fixed level of $H_2O$. Thus, the upper curve represents solvent combinations wherein the amount of NMP varies from 0 to 100 LV%, but each combination contains 3 LV% $H_2O$.

Referring to the 0% $H_2O$ curve, it is seen that a solvent comprising 50 LV% NMP in phenol/NMP yields a miscibility temperature of 232°F., while that for phenol is 167°F. and for NMP is 183°F. This means that at an equal volume solvent/oil treat ratio, a single phase liquid system will be encountered at 167°F. for phenol, 183°F. for NMP, but not until 232°F. is reached with a solvent comprised of 50 LV% NMP in phenol/NMP. As a practical matter, this means that one could carry out the extraction at up to about 200°F. with the 50 LV% NMP in phenol/NMP, but only up to about 130°F. using phenol and 160°F. using NMP as the extraction solvent. The effect of adding $H_2O$ to phenol, NMP and phenol/NMP is to raise the miscibility temperature.

Figure 2:
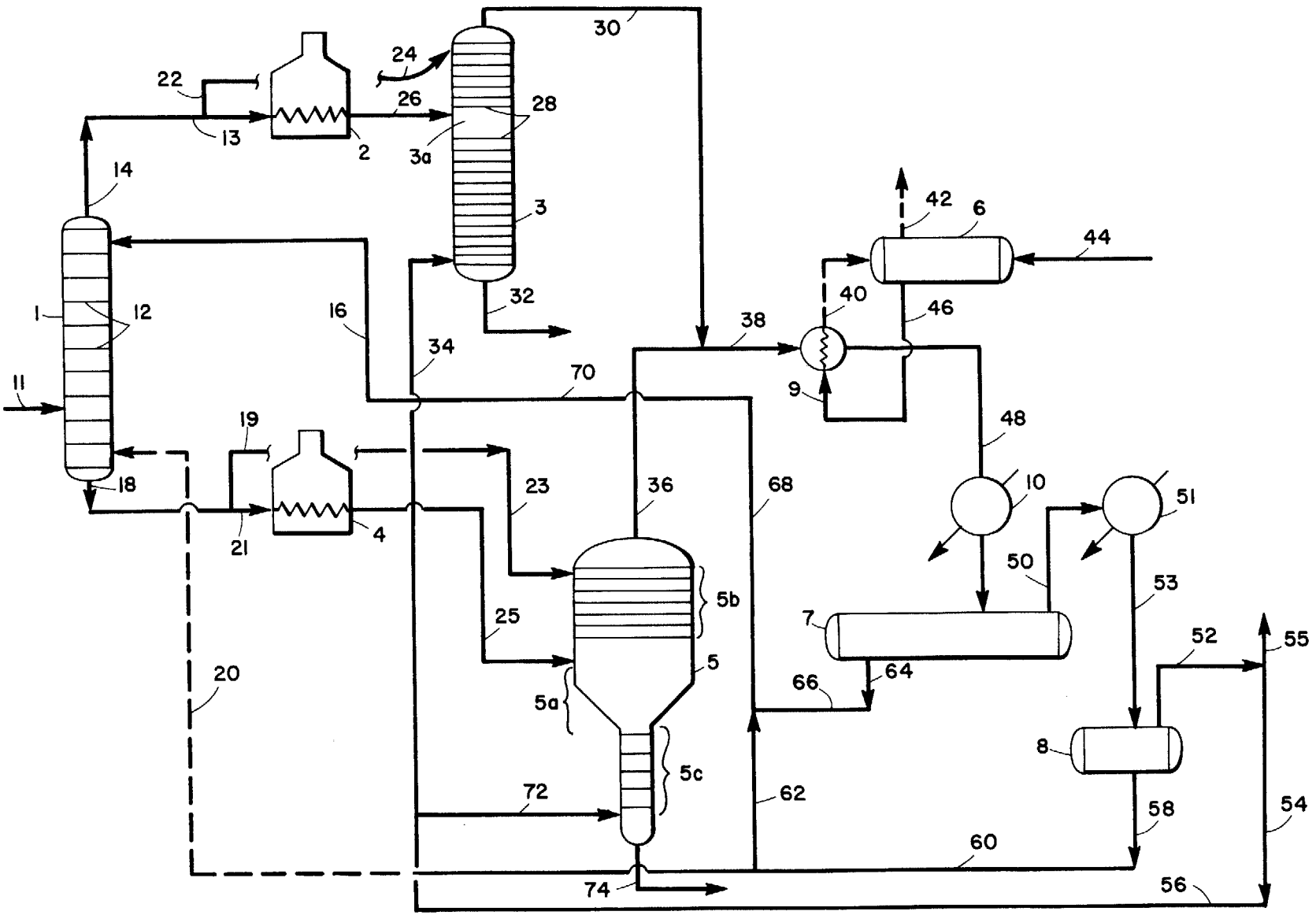

FIG. 2 represents a simplified flow scheme displaying a preferred embodiment of the subject process.

Turning to the drawing in detail, a lubricating oil feedstock is introduced into extraction tower 1 via line 11 wherein it is contacted with a solvent selective for aromatic-type constituents contained in the lubricating oil feedstock, the solvent comprising a major portion of n-methyl-2-pyrrolidone and phenol with a minor portion of water, and where the amount of water present in the solvent ranges between about 0 and about 10 LV%, preferably between about 1 and about 4 LV% based on the total amount of phenol, NMP and water in the solvent and wherein the amount of phenol in the solvent comprises between about 20 and about 80 LV%, preferably between about 25 and 50 LV% based on total NMP, phenol and water in the solvent.

The components of the solvent, in the embodiment displayed in FIG. 2 are introduced into the extraction zone 1 already premixed, through line 16. The solvent/ treat ratio will specifically range between about 50 and 600 LV% based on feed, more preferably between about 100 and 300 LV%. The temperature within the extraction zone is maintained between about 100° and 300°F., preferably between about 120° and 250°F. for a time sufficient to remove the desired amount of aromatic, sulfur and nitrogen-containing constituents from the lubricating oil feedstock, and to permit thorough settling of the two liquid phases. As a consequence of the extraction process, raffinate and extract phases are formed and separately removed from the extraction zone via lines 14 and 18 respectively. The raffinate phase is passed through preheater 2 wherein its temperature is increased to between about 500° and 700°F. and then introduced into a raffinate solvent separation zone 3 via line 26. The separation zone preferably comprises a distillation tower divided into a plurality of stages and is maintained at a temperature typically ranging between about 400° and 700°F., for example, 400° to 560°F. at the top, 650° to 700°F. at the flash zone (3*a*) and 600° to 700°F. at the tower bottom, and at a pressure ranging between about 0 and 60 psig, preferably between about 30 and 50 psig.

As indicated in a preferred embodiment, the tower is divided into a series of stages 28 and permits the facile vaporization of a substantial portion of solvent from the raffinate. Additional trace amounts of solvent that are not removed via this vaporization, may be so removed by contacting the raffinate therein with a stripping gas which is substantially non-reactive such as nitrogen, light hydrocarbons, methane or hydrogen at ratios of about 0.5 to about 2.0 moles of gas per barrel of oil. The stripping gas is introduced into the separation tower via line 34. In an alternative embodiment, the raffinate phase, prior to introduction into the separation tower, can be segregated into at least two streams, one of which will contain a major portion of the raffinate phase and the other stream containing a minor portion of the raffinate phase. As shown in FIG. 2, the stream containing a minor portion of raffinate phase, i.e., the reflux stream, is introduced via lines 22 and 24 into the top of separation zone 3 wherein it acts as a reflux, cooling and "desuperheating" the solvent vapor from the flash zone and condensing out most of the oil vapors.

Use of "feed reflux" in the tower reduces the heat load, since this part of the feed bypasses the furnace. On relatively low viscosity lube feedstocks, such as transformer oil, which typically boils in the range of 550° to 700°F., there is another advantage to the use of "feed reflux." Particularly in the raffinate tower, the high activity coefficient of the oil in small concentration in the solvent causes the oil to vaporize at a low temperature. Thus, the front end (550°F. normal boiling range material) tends to go overhead with the solvent. By introducing a substantial quantity of heavier oil (e.g., 650°–700°F. boiling range material) onto the top trays of the tower, the liquid composition on these trays is altered to a lower solvent content. The heavy oil does not vaporize to any significant extent, but the altered liquid composition reduces the activity coefficient of the 550°F. boiling range material so that it remains largely in the liquid phase and does not build up in the recovered solvent to an excessive degree. The reflux stream is introduced into the separation tower at a temperature less than that of the stream containing the bulk of the raffinate phase, which latter stream enters separation zone 3 via lines 13 and 26.

The extract phase which initially forms in the extraction tower 1 is removed via line 18 and processed in a manner similar to that used for the raffinate phase. Thus, in one embodiment of the process, the extract phase is introduced into preheater 4 via line 21 wherein it is heated to a temperature ranging between about 450° and 700°F. Subsequently, it is introduced into the flash zone (5*a*) of the extract solvent separation zone 5 via line 25. A rectification zone (5*b*) is provided above the flash zone (5*a*) in which excessive oil is removed from the solvent vapors by use of liquid solvent reflux to the top of the tower, or, preferably, by use of a portion of the feed as reflux as described previously in reference to the raffinate phase. Typically, the rectification zone consists of about seven fractionation trays, although more or less trays or other contacting devices, like packing, may be used. Below the flash zone, the tower is provided with a stripping zone (5*c*) typically comprising 20 or 25 stripping trays or packing, in which the remaining solvent is stripped out by an inert vapor injected near the bottom of the tower (through line 72). The diameter of the rectification zone is normally much larger than that of the stripping zone, because of the relatively higher volume of solvent vapor due to vaporization in the preheat furnace. The tower is maintained at a temperature ranging between about 400° and 700°F., the tower top is preferably maintained between about 400° and 560°F., the flash zone between about 550°-650°F., and the bottom between about 500°-600°F. Solvent vapors from the extract and raffinate separation towers are removed by lines 36 and 30 and combined in line 38. As the hot solvent vapor is cooled, and condensed, it liberates a large amount of latent heat over the approximate range of 450° to 300°F. If desired, much of this heat can be used to convert boiler feed water to useful steam. Treated and deaerated boiler feed water is introduced through line 44 to a steam drum 6. Water from the steam drum passes through line 46 to the heat exchanger 9 where part of it is vaporized to steam by the condensing solvent vapors from line 38. The steam and unvaporized water pass through line 40 back to the steam drum where the steam disengages from the water and leaves the unit through line 42. This steam is typically at a pressure of 125 to 150 psig and the corresponding saturation temperature. Depending on the particular heat exchanger arrangements (not shown) for internal recovery of heat, the amount of steam generated is typically between 35 and 75 pounds of steam per barrel of solvent circulated. The value of this steam is an economic credit for the process.

The solvent vapors and condensed liquid from the steam generator are fed via line 48 through trim heat exchanger 10 and into a first solvent drum 7, which drum is maintained at a pressure ranging between about 0 and 50 psig, preferably between about 25 and 30 psig and at a temperature ranging between about 250° and 450°F., preferably between about 275° and 350°F. Since the normal boiling point of water is considerably below that of phenol (360°F.) or NMP (395°F.), the overhead vapors comprising a much larger concentration of water than the circulating solvent going back to the extraction zone via line 68 are withdrawn from drum 7 via line 50 passing through heat exchanger 51 and entering drum 8 via line 53. The condensed vapors are passed into a second solvent drum 8, which is maintained at a temperature ranging between about 80° and 160°F., preferably between about 90° and 110°F., at substantially the same pressure as drum 7. If the composition of the circulating solvent is relatively rich in NMP (about 60 to 85 LV% based on the NMP-phenol content), the condensed phase in drum 8 is substantially one liquid phase, even at relatively low temperatures of 90° to 110°F. Its exact composition depends upon the composition of the total circulating solvent within the ranges described heretofore, and on the operating conditions in drums 7 and 8. This represents a significant improvement over prior art phenol-water extraction processes which led to two liquid phases in settling drums analogous to 8, thereby complicating control of the water content in the recycle solvent.

As noted above, drum 8 is richer in water than drum 7. The liquid in drum 8 is withdrawn therefrom via line 58, while the liquid in drum 7 is withdrawn via line 64. In one embodiment of the invention, the water-rich stream is withdrawn from drum 8 via line 58 and passed via lines 60 and 62 to line 66 wherein it is mixed with the NMP/phenol-rich stream therein. The mixed stream is then recycled via lines 68, 70 and 16 to the initial extraction zone 1. Alternatively, all or a portion of the water-rich stream may be passed directly via lines 58, 60 and 20 into the bottom of extraction tower 1, while the NMP/phenol-rich stream is passed via lines 64, 66, 68, 70 and 16 to the top of tower 1. As explained previously, injection of the water-rich stream into the bottom of the extraction tower below the feed is advantageous in inducing reflux.

Raffinate product exits tower 3 via line 32 and may pass to tankage or may be further processed to obtain further color and carbon residue and V. I. improvement. Thus, for example, the hot raffinate may be mixed with a hydrogen-containing gas and sent directly to a reactor containing a hydrofining catalyst, such as cobalt or nickel molybdate on alumina, for further color improvement. The hydrofined raffinate may then be dewaxed to obtain a lube base stock of suitable pour point. In a similar fashion, extract product from tower 5 is withdrawn via line 74 and may pass to tankage or be further processed. Stripping gas is withdrawn from drum 8 by line 52 and contains traces of water, phenol and NMP. The stripping gas is then recycled via lines 56 and 72 to the extract phase separation tower and also via lines 56 and 34 to the raffinate phase separation tower 3. Occasionally, a small amount of extraneous water may be introduced into the process by entrainment or solution in the feed. This can be removed by allowing the small purge of stripping gas containing traces of water from the cold solvent drum 8 to go to disposal such as a furnace fire box.

PREFERRED EMBODIMENT

The invention will be more apparent from the preferred embodiment and working examples set forth hereinbelow:

EXAMPLE 1

A Light Arabian 150ON distillate was mixed with solvents comprising various mixtures of phenol, NMP and $H_2O$, at an equal volume solvent/oil treat ratio. The initial mixing of each solvent/oil combination was done at room temperature, with agitation sufficient to obtain a cloudy dispersion of the initially immiscible two-phase solvent/oil system. The temperature was slowly raised, while maintaining agitation, until a clear, miscible, single phase solution was obtained for each solvent/oil system. The temperature at which a clear, single phase solvent/oil solution was obtained was recorded as the miscibility temperature.

Figure 1:
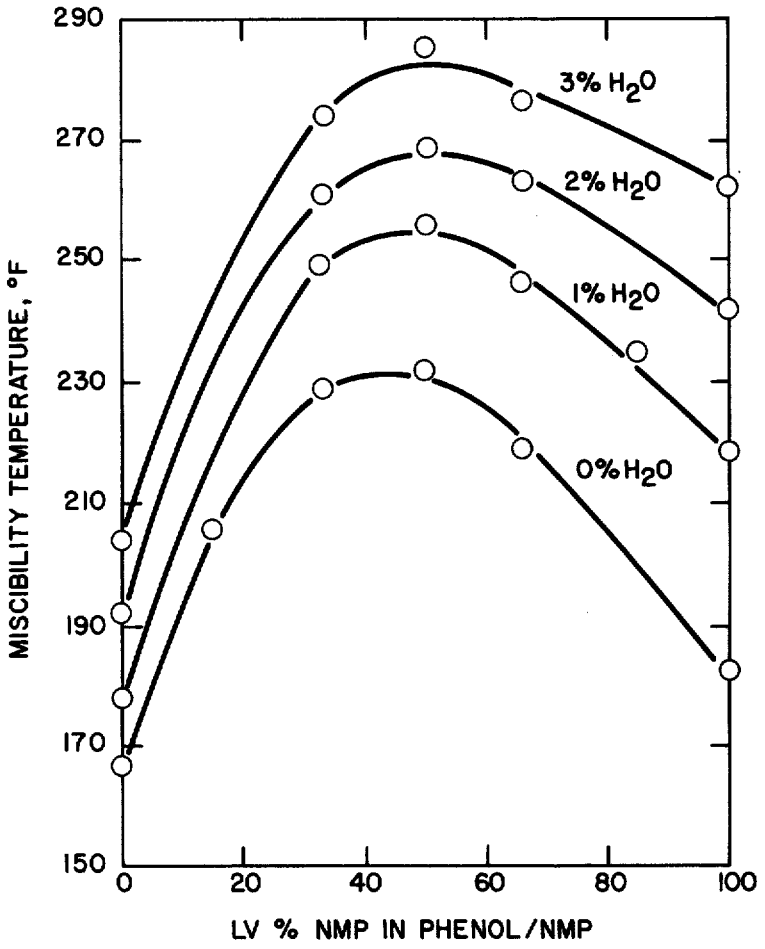
FIG. 1 is a plot of the temperature-miscibility data contained in Table I at an equal volume solvent/ oil treat ratio.

Table I lists the results and FIG. 1 is a plot of those results. These data clearly show the higher solvent/oil miscibility temperatures obtained using solvents comprising phenol/NMP (with or without $H_2O$), compared to using either phenol or NMP alone (with or without water). Because the practicable extraction temperature for any solvent/oil system depends on the miscibility temperature of that system, it is obvious that this invention allows substantially higher extraction temperatures than would be possible using solvents not comprising both phenol and NMP.

EXAMPLE 2

A distillate from Lt. Arabian crude of 19.8°API and having a viscosity of 1545 SSU/100°F., a sulfur content of 2.68 percent, nitrogen content of 1010 PPM, and a V. I. of 53.5 after dewaxing to 15°F. pour was extracted in a pilot plant countercurrent tower with phenol and with phenol/NMP mixtures with the following results:

TABLE I

MISCIBILITY TEMPERATURES FOR PHENOL/NMP/$H_2O$/ARAB LIGHT 150N DISTILLATE SYSTEM

| LV % NMP in Phenol/NMP[3] | Miscibility Temperature, °F,[1,2] 0% $H_2O$ | 1% $H_2O$ | 2% $H_2O$ | 3% $H_2O$ |
|---|---|---|---|---|
| 0 | 167 | 178 | 192 | 204 |
| 15 | 206 | — | — | — |
| 33 | 229 | 249 | 261 | 274 |
| 50 | 232 | 256 | 268 | 285 |
| 67 | 219 | 247 | 263 | 277 |
| 85 | — | 235 | — | — |
| 100 | 183 | 218 | 242 | 262 |

[1] For equal volumes of solvent and oil.
[2] LV% $H_2O$ based on phenol, NMP and $H_2O$.
[3] LV% NMP based on the phenol and NMP in the solvent

TABLE II

| Solvent | Phenol | Phenol/NMP (1/1 Vol. Ratio) | |
|---|---|---|---|
| Water, LV% on Solvent* | | | |
| Premixed | 6 | 1 | 0 |
| Injected at tower bottom | 0 | 0 | 1.3 |
| Temperature of Extraction, °F | 180 | 180 | 180 |
| Treat, LV% on Feed | 176 | 151 | 143 |
| Raffinate Yield, LV% on Feed | 65 | 65 | 70 |
| Raffinate V.I. (after dewaxing) | 91 | 91.5 | 90.5 |
| Waxy Color, ASTM | <5.5 | <4.5 | 4.5 |
| Solvent in Raffinate, LV% | 13.5 | 9.6 | 9.6 |

*NMP, phenol and water

These data illustrate the following advantages of the NMP/phenol/water mixture as compared with phenol alone:

Substantially equivalent yields and V.I. are achieved with the mixed NMP/phenol/water solvent system with lower treat and lower solvent-water content than with phenol. This confirms the inherently better selectivity of the mixed solvent vis-a-vis the phenol-$H_2O$ system.

Color of the raffinate from the mixed NMP/phenol/-water solvent system was better than that with phenol-water alone.

Solvent dissolved in the raffinate phase was lower with the mixed NMP/phenol/water solvent than with phenol-water, which means less heat load on the raffinate recovery operation.

Only 1.3 LV% water injected at the tower bottom improves the raffinate yield significantly when NMP/phenol/water is used as the solvent. It is also noted that the 65 LV% yield of raffinate, using phenol-water as solvent, required a treat of 176 LV% (on feed) versus 143 LV% for the NMP/phenol/water (1.3 LV%) solvent system.

EXAMPLE 3

The same Lt. Arabian feedstock as used in Example 2 was batch-extracted with four 75 percent treats of solvent using phenol, NMP, and NMP/phenol mixtures with varying amounts of water with the following results.

TABLE III

| Solvent | Phenol | NMP | | NMP/Phenol, 1/1 LV Ratio | |
|---|---|---|---|---|---|
| % Water in Solvent | 5 | 1 | 2 | 0 | 1 |
| Temperature, °F | 170 | 170 | 170 | 185 | 170 |
| Raffinate Yield, LV% on Feed | 58.9 | 56.9 | 63.3 | 55.8 | 64.3 |
| Raffinate V.I., Dewaxed | 90 | 93 | 89 | 93 | 88 |
| Raffinate Color, ASTM | <5.5 | <4.0 | 4.5 | 4.5 | — |
| Raffinate Sulfur, % | 1.24 | 1.05 | 1.24 | 1.12 | — |
| Raffinate Nitrogen, PPM | 110 | 150 | 180 | 110 | — |

These data show that the yield/V.I. relationship of NMP/phenol is about the same as with NMP alone, but that the nitrogen removal with the NMP/phenol mixed solvent is better than NMP and equal to that of phenol. The color of the raffinates with either NMP or NMP/phenol mixtures is better than with phenol alone. At a given water content, the mixed solvent can operate at a higher temperature than either phenol or NMP for a given yield (conversely, water content must be lower with the mixed solvent at otherwise constant conditions to get the same yield or V.I.).

EXAMPLE 4

A lower viscosity distillate from Lt. Arabian crude, having a gravity of 24.1°API and a viscosity (after dewaxing) of 249 SSU/100°F. and a V.I. of 66 was batch-extracted with four 85 percent treats of various solvents at 140°F. with the following results:

TABLE IV

| Solvent | Phenol | NMP | | NMP/Phenol LV Mixtures | | | | | |
|---|---|---|---|---|---|---|---|---|---|
| LV Ratio, NMP/Phenol | — | — | | 2/1 | | 1/1 | | 1/2 | |
| Water Content of Solvent, % | 6 | 1 | 2 | 1 | 2 | 1 | 2 | 1 | 2 |
| Raffinate Yield, LV% | 60.5 | 59.3 | 64.7 | 62.3 | 67.9 | 64.2 | 67.5 | 62.3 | 65.6 |
| Raffinate V.I., Dewaxed | 105.5 | 107.5 | 104 | 106 | 101 | 104 | 102 | 105 | 103 |

These data reflect the fact that NMP, or NMP/phenol mixtures (containing varying amounts of water) of 2/1, 1/1 and 1/2 ratios show about 2 percent higher raffinate yield for a given V.I. as compared with phenol (water) alone. They also show that at comparable conditions the yield of raffinate from the mixed solvents is always higher (i.e., lower oil solubility) than with NMP (water) at a given temperature and treat. They confirm the observations in Examples 2 and 3 that the NMP/phenol mixture can operate at much lower water content than with phenol alone.

What is claimed is:

1. A process for upgrading a lubricating oil stock which comprises:
   1. contacting said lubricating oil stock with a solvent comprising n-methyl-2-pyrrolidone and phenol wherein the amount of phenol in said solvent ranges between about 20 and 80 LV% based on the total amount of n-methyl-2-pyrrolidone and phenol in the solvent;
   2. forming an extract phase and a raffinate phase; and
   3. recovering an upgraded lubricating oil from said raffinate phase.

2. The process of claim 1 wherein the amount of phenol in said solvent ranges between about 25 and 50 LV% based on the total amount of n-methyl-2-pyrrolidone and phenol in the solvent.

3. The process of claim 1 wherein said lubricating oil stock is contacted with said solvent at a temperature ranging between about 100° and 300°F.

4. In a process for the upgrading of an aromatic, sulfur and nitrogen-containing hydrocarbon oil feedstock, the steps of contacting said feedstock with a solvent having preferential selectivity for the aromatic, sulfur and nitrogen-containing constituents in said feedstock, said solvent comprising a mixture of n-methyl-2-pyrrolidone and phenol wherein the amount of phenol in said solvent ranges between about 20 and 80 LV% based on the total amount of n-methyl-2-pyrrolidone and phenol in the solvent, thereby forming a raffinate phase comprising a minor amount of said solvent and an extract phase comprising a major amount of said solvent, removing at least a portion of the solvent from said raffinate phase in a raffinate solvent separation zone, at a temperature ranging between about 400° and 700°F. and at a pressure ranging between about 0 and 60 psig, thereby vaporizing at least a portion of the solvent from said raffinate phase, removing a further portion of said solvent from said raffinate phase by contacting same with a substantially non-reactive stripping gas, and, thereafter, recovering an upgraded hydrocarbon oil from said raffinate phase.

5. The process of claim 4 wherein at least a portion of the solvent contained in said extract is removed in an extract solvent separation zone at a temperature ranging between about 400° and 700°F. and at a pressure ranging between about 0 and 60 psig and wherein a further portion of the solvent is removed from said extract phase by contacting same with a substantially nonreactive stripping gas.

6. The process of claim 4 comprising the additional steps of dividing the raffinate phase, prior to introduction into said separation zone, into a first stream comprising a major portion of said raffinate phase and a second stream comprising a minor portion of said raffinate phase, separately introducing said streams into said separation zone, said second stream being introduced therein at a temperature below that of said first stream and wherein said second stream is used as a reflux stream to cool vapors in said separation zone.

7. The process of claim 4 wherein the amount of phenol in said solvent ranges between about 25 and 50 LV% based on the total amount of n-methyl-2-pyrrolidone and phenol in the solvent.

8. The process of claim 4 wherein said substantially non-reactive stripping gas is selected from the group consisting of nitrogen, methane, hydrogen, the light hydrocarbons and mixtures thereof.

9. A process for upgrading a lubricating oil stock which comprises:
   1. contacting said lubricating oil stock with a solvent comprising n-methyl-2-pyrrolidone, phenol and a minor amount of water wherein the amount of water in said solvent ranges between about 0 and 10 LV% based on the total amount of n-methyl-2-pyrrolidone, phenol and water in the solvent and wherein the amount of phenol in said solvent ranges between about 20 and 80 LV% based on the total amount of n-methyl-2-pyrrolidone, phenol and water in the solvent;
   2. forming an extract phase and a raffinate phase; and
   3. recovering an upgraded lubricating oil from said raffinate phase.

10. The process of claim 9 wherein the amount of water in said solvent ranges between about 1 and 4 LV% based on the total amount of n-methyl-2-pyrrolidone, phenol and water in the solvent and wherein the amount of phenol in said solvent ranges between about 25 and 50 LV% based on the total amount of n-methyl-2-pyrrolidone, phenol and water in the solvent.

11. The process of claim 9 wherein said lubricating oil stock is contacted with said solvent mixture at a temperature ranging between about 100° and 300°F.

12. In a process for the upgrading of an aromatic, sulfur and nitrogen-containing hydrocarbon oil feedstock, the steps of contacting said feedstock with a solvent having preferential selectivity for the aromatic, sulfur and nitrogen-containing constituents in said feedstock, said solvent comprising a mixture of n-methyl-2-pyrrolidone, phenol and a minor amount of water wherein the amount of phenol in said solvent ranges between about 20 and 80 LV% based on the total amount of n-methyl-2-pyrrolidone, phenol and water in the solvent and wherein the amount of water in said solvent ranges between about 0 and 10 LV% based on the total amount of n-methyl-2-pyrrolidone, phenol and water in the solvent, thereby forming a raffinate phase comprising a minor amount of said solvent and an extract phase comprising a major amount of said solvent, removing at least a portion of the solvent from said raffinate phase in a raffinate solvent separation zone, at a temperature ranging between about 400° and 700°F., and at a pressure ranging between about 0 and 60 psig, thereby vaporizing at least a portion of solvent from said raffinate phase, removing a further portion of said solvent from said raffinate phase by contacting same with a substantially non-reactive stripping gas, and thereafter, recovering an upgraded hydrocarbon oil from said raffinate phase.

13. The process of claim 12 wherein at least a portion of the solvent contained in said extract phase is removed in an extract solvent separation zone at a temperature ranging between about 400° and 700°F. and at a pressure ranging between about 0 and 60 psig and wherein a further portion of the solvent is removed from said extract phase by contacting same with a substantially non-reactive stripping gas.

14. The process of claim 13 comprising the additional steps of removing at least a portion of said solvent from the extract and raffinate solvent separation zones, introducing said solvent into a first solvent drum maintained at a temperature ranging between about 275° and 350°F. and at a pressure ranging between about 0 and 50 psig, whereby a liquid phase, rich in n-methyl-2-pyrrolidone and phenol and a vapor phase rich in water, are formed, removing from said drum at least a portion of said vapor phase and introducing same into a second solvent drum maintained at a temperature ranging between about 90° and 160°F and at a pressure substantially the same as that in said first solvent drum, whereby at least a portion of said vapor phase is condensed which is richer in water than the liquid phase in said first solvent drum.

15. The process of claim 14 wherein the n-methyl-2-pyrrolidone content of the solvent introduced into the extraction zone is about 60 to 85 LV% based on the NMP-phenol content of said solvent and where the condensate in the second solvent drum comprises one completely miscible liquid phase which is richer in water than the liquid phase in said first solvent drum.

16. The process of claim 12 comprising the additional steps of dividing the raffinate phase, prior to introduction into said separation zone, into a first stream comprising a major portion of said raffinate phase and a second stream comprising a minor portion of said raffinate phase, separately introducing said streams into said separation zone, said second stream being introduced therein at a temperature below that of said first stream and wherein said second stream is used as a reflux stream to cool the vapors in said separation zone.

17. The process of claim 12 wherein the amount of phenol in said solvent ranges between about 25 and 50 LV% based on the total amount of n-methyl-2-pyrrolidone, phenol and water in the solvent and wherein the amount of water in the solvent ranges between about 1 and 4 LV% based on the total amount of n-methyl-2-pyrrolidone, phenol and water in the solvent.

18. The process of claim 12 wherein said substantially non-reactive stripping gas is selected from the group consisting of nitrogen, methane, hydrogen, the light hydrocarbons and mixtures thereof.

19. In a process for the upgrading of a lubricating oil stock, the steps of contacting said lubricating oil stock in an extraction zone, with a solvent comprising a mixture of n-methyl-2-pyrrolidone, phenol and a minor amount of water wherein the amount of phenol in said solvent ranges between about 20 and 80 LV% based on the total amount of n-methyl-2-pyrrolidone, phenol and water in the solvent and wherein the amount of water in said solvent ranges between about 0 and 10 LV% based on the total amount of n-methyl-2-pyrrolidone, phenol and water in the solvent, and wherein the n-methyl-2-pyrrolidone and phenol are introduced as a mixture at the top of said zone and wherein the water is introduced into the bottom of said zone.

20. The process of claim 19 wherein the amount of phenol in said solvent ranges between about 25 and 50 LV% based on the total amount of n-methyl-2-pyrrolidone, phenol and water in the solvent and wherein the amount of water in the solvent ranges between about 1 and 4 LV% based on the total amount of n-methyl-2-pyrrolidone, phenol and water in the solvent.

* * * * *